US005524421A

United States Patent [19]

Nauheimer et al.

[11] Patent Number: 5,524,421

[45] Date of Patent: Jun. 11, 1996

[54] ONE PASS SYSTEM FOR FORMING STUFFED ENVELOPES

[75] Inventors: Donald J. Nauheimer, LaGrange; David J. Nowaczyk, Carol Stream; Paul L. Giuntoli, Elk Grove, all of Ill.

[73] Assignee: Wallace Computer Services, Inc., Hillside, Ill.

[21] Appl. No.: 354,049

[22] Filed: Dec. 6, 1994

Related U.S. Application Data

[63] Continuation-in-part of Ser. No. 313,643, Sep. 27, 1994.

[51] Int. Cl.[6] ..... B65B 11/48; B65B 49/02

[52] U.S. Cl. ..... 53/460; 53/117; 53/206; 53/429; 53/569; 493/216

[58] Field of Search ..... 53/460, 206, 569, 53/450, 550, 455, 429, 435, 562, 558, 520, 117, 452; 493/216

[56] References Cited

U.S. PATENT DOCUMENTS

| | | | |
|---|---|---|---|
| 22,405 | 12/1858 | Arnold . | |
| 1,493,432 | 5/1924 | Geffroy . | |
| 3,593,485 | 7/1971 | Stovall | 493/216 X |
| 3,641,733 | 2/1972 | Lerner | 53/455 X |
| 3,808,768 | 5/1974 | Dobbs | 53/460 |
| 4,205,504 | 6/1980 | Gregoire et al. | 53/520 |
| 4,312,169 | 1/1982 | Golicz et al. | 53/206 |
| 4,668,212 | 5/1987 | Kotani | 493/216 |
| 4,769,969 | 9/1988 | Minami | 53/117 |
| 4,912,909 | 4/1990 | Stenner | 53/429 |
| 4,972,655 | 11/1990 | Ogawa | 53/569 X |
| 5,005,337 | 4/1991 | Kluth | 53/460 |
| 5,154,040 | 10/1992 | Dureuil | 53/450 X |
| 5,155,973 | 10/1992 | Hipko et al. | 53/460 X |
| 5,233,812 | 8/1993 | Coppola | 53/411 |

*Primary Examiner*—James F. Coan

*Attorney, Agent, or Firm*—Roylance, Abrams, Berdo & Goodman

[57] ABSTRACT

A system for forming and sealing envelopes stuffs each envelope with an insert. Envelope blanks are received and fed to an envelope former. The envelope former partially forms the envelope blanks with a sealed longitudinal end and an open longitudinal end. Insert blanks are fed and are formed into inserts. The inserts are moved along longitudinal axes and into the open longitudinal ends of the partially formed envelope blanks parallel to the envelope longitudinal axes.

33 Claims, 4 Drawing Sheets

ONE PASS SYSTEM FOR FORMING STUFFED ENVELOPES

REFERENCE TO RELATED APPLICATION

This application is a continuation-in-part of copending U.S. patent application Ser. No. 08/313,643 to Nauheimer et al., filed Sep. 27, 1994 and entitled One Pass System For Forming Stuffed Envelopes.

FIELD OF THE INVENTION

The present invention relates to an apparatus and a method for forming and sealing envelopes with each envelope being stuffed with at least one insert. More particularly, the present invention relates to forming and stuffing envelopes in a single pass where the inserts are longitudinally inserted when the envelopes are partially formed with one longitudinal end closed and one longitudinal end open.

BACKGROUND OF THE INVENTION

Suppliers of many products and services employ high volume direct mail advertising. Such mass mailings may include personalized information on the envelope alone or on the envelope and on inserts within the envelope. Inclusion of personalized information on the inserts requires coordination of the printing and stuffing of the envelopes to ensure that the inserts are stuffed within the correct envelope.

The stuffed envelopes should also have the appearance, to the greatest extent possible, of correspondence individually and manually prepared for the addressee and should avoid the appearance of mere "junk mail". One way to avoid the "junk mail" appearance is for the envelope to substantially appear to be a regular mail envelope. Such envelopes are normally identified by the generally triangular closure flaps.

Automated systems for stuffing pre-formed envelopes require complex mechanism, for example, air streams, to open the envelopes for receiving the inserts. However, such mechanisms are not efficient and are relatively complex.

Other systems make and fold an envelope around an insert. For example, U.S. Pat. No. 4,312,169 to Golicz et al. discloses a system in which the envelope and insert are formed from the same web with individual or personal information printed on the portions forming both the envelope and the insert. After the insert and the envelope are separated, the insert is folded and the folded insert is placed on the rear face of the front panel of the envelope. The insert is fed in a direction parallel to the longitudinal or longest dimension of the envelope, as the envelope moves on a conveyor in a direction perpendicular to the envelope longitudinal direction. Once the insert is located on the envelope front panel, the envelope back panel is folded over the insert. Subsequently, a closure flap is folded over to seal the envelope. Adhesive is applied to seal the envelope. Additional inserts can be added sequentially.

U.S. Pat. No. 4,205,504 to Gregoire et al also discloses making and stuffing envelopes from a continuous web. Glue strips are printed on the web by a glue applicator. The envelope is formed by folding. After the envelope is formed, inserts are inserted through the open top of the envelope in a direction transverse to the longitudinal direction of the envelope. After one or more inserts are added, the envelope closure flap is glued and folded over by a plow folder to seal the envelope. Individual stuffed envelopes are separated by a shears along the side glue lines of the envelope.

Other envelope stuffing systems are disclosed in U.S. Pat. Nos. 5,115,973 to Hipco et al, 4,668,212 to Kotani, 4,912,999 to Stenner and 5,233,812 to Coppola. However, none of these prior systems form the envelopes and stuff the inserts into the envelopes in a single pass to provide a simple yet effective mechanism for forming stuffed envelopes.

SUMMARY OF THE INVENTION

An object of the present invention is to provide an apparatus and a method for forming and sealing stuffed envelopes where the envelopes can be efficiently and effectively formed in a single pass.

Another object of the present invention is to provide a method and apparatus for forming stuffed envelopes in which the envelopes are stuffed in a single pass with the inserts inserted longitudinally into the envelopes when the envelopes are partially formed with one longitudinal end closed and one longitudinal end open.

A further object of the present invention is to provide a method and apparatus for forming stuffed envelopes which is easily adaptable to different inserts and printing systems.

The foregoing objects are basically obtained by an apparatus for forming and sealing envelopes which are each stuffed with at least one insert. The apparatus comprises envelope input means for receiving and feeding envelope blanks with opposite first and second ends, and envelope forming means downstream of the envelope input means for partially forming the envelope blanks with the first longitudinal ends sealed and the second longitudinal ends open. Insert input means are located upstream of the envelope forming means for receiving and feeding insert blanks along longitudinal axes of the insert blanks. Insert forming means are located between the insert input means and the envelope forming means for forming the insert blanks into inserts. Stuffing means are provided adjacent to the envelope forming means for moving the inserts along longitudinal axes and into the open second longitudinal ends of the envelope blanks parallel to the longitudinal axes of the envelope blanks. The envelope blanks are partially formed in the envelope forming means when receiving the inserts.

The foregoing objects are also basically obtained by a method for forming and sealing envelopes, each stuffed with at least one insert. The method comprises receiving and feeding envelope blanks with opposite first and second longitudinal ends, forming the envelope blanks with the first longitudinal ends sealed and the second longitudinal ends open, receiving and feeding insert blanks along longitudinal axes thereof, forming the insert blanks into inserts, and moving the inserts along longitudinal axes thereof and into the open second longitudinal ends of the partially formed envelope blanks parallel to the longitudinal axes of the envelope blanks.

By forming the apparatus and performing the method in this manner, the envelopes are formed and stuffed efficiently and effectively in a single pass. The envelopes and the inserts can be suitably printed prior to delivery to the respective input means with or without personal information on each. The delivery of the envelope blanks and the inserts to the envelope forming means can then be coordinated or synchronized to ensure that the proper inserts are stuffed within the proper envelope, allowing the apparatus and method to be adapted for a wide variety of applications or uses.

Since the inserts are moved along longitudinal directions and are inserted in the longitudinal directions of the partially formed envelopes, the envelope shape can be formed with substantially the same appearance as a regular mail envelope. The envelope formation and the insertion of inserts can be accomplished quickly and effectively in a relatively small space. Separate means for opening the envelopes are eliminated.

Other objects, advantages and salient features of the present invention will become apparent from the following detailed description, which, taken in conjunction with the annex drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
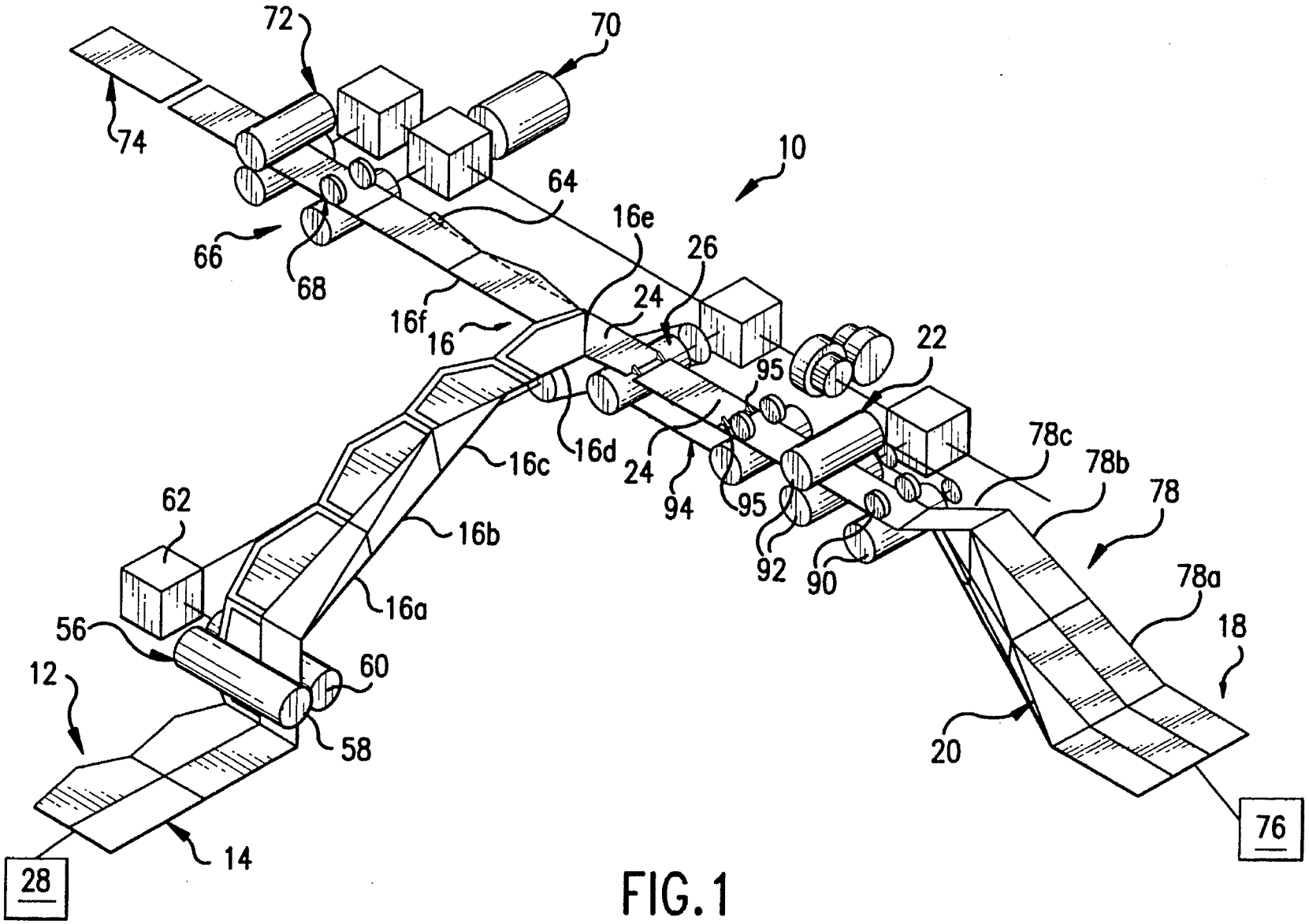
FIG. 1 is a perspective view graphically illustrating the method and apparatus for forming and sealing stuffed envelopes according to the present invention.
Figure 2:
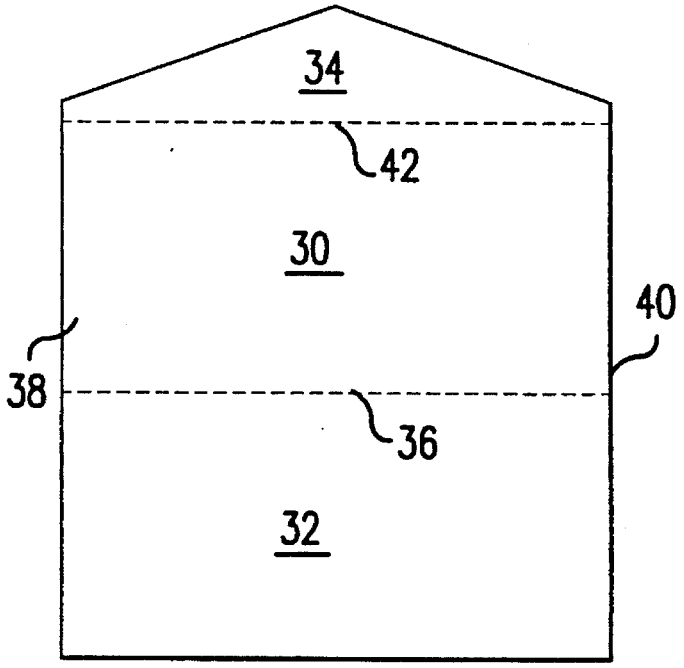
FIG. 2 is a plan view of the outer surface of a single envelope blank used in the system of FIG. 1.

Referring initially to FIG. 1, the apparatus 10 for forming and sealing envelopes, each of which is stuffed with at least one insert, comprises envelope input means 12 for receiving and feeding envelope blanks 14 and envelope forming means 16 located in a downstream direction of the conveying of the envelope blanks from envelope input means 12. Insert input means 18 are located upstream of envelope forming means 16 in the direction of conveying of insert blanks 20, and receive and feed the insert blanks along their longitudinal axes. Insert forming means 22 are located between insert input means 18 and envelope forming means 16, and form insert blanks 20 into inserts or sets of inserts 24. Stuffing means 26 are located adjacent envelope forming means 16. The stuffing means move the inserts along their longitudinal axes and generally parallel to the longitudinal axes of the envelope blanks when each envelope blank is partially formed within the envelope forming means with one end open and its opposite end closed. The inserts enter the partially formed envelopes along the envelope longitudinal axis and through the one open longitudinal end of each partially formed envelope.

Envelope input means 12 receives envelope blanks 14 from an envelope blank preparation station 28. Station 28 can comprise means for cutting and forming the envelope from blank paper stock, or can include an unwinding mechanism for unwinding a roll of a continuous material web preformed into envelope blanks coupled end-to-end. Additionally, station 28 can include a printer, such as an ink jet or ion dep printer for printing appropriate information on the envelope. In lieu of a printer, a window patch unit can be provided in station 28 for forming a transparent or translucent window in the envelope to permit the recipient's name and address and/or other information provided on the insert to be readable through the front of the envelope.

Envelope blanks 14, as illustrated in FIG. 1 are connected longitudinal end to longitudinal end as a continuous web. As best illustrated in FIGS. 2–5, each envelope blank comprises front panel 30, a back panel 32 and a closure flap 34. Panels 30 and 32 are generally rectangular in shape and are hingedly coupled along a fold line 36 which extends between the opposite longitudinal ends 38 and 40 of the envelope blank. Closure flap 34 is generally triangular in shape with its base hingedly coupled along fold line 42 to the side of front panel 30 remote from back panel 32.

Figure 3:
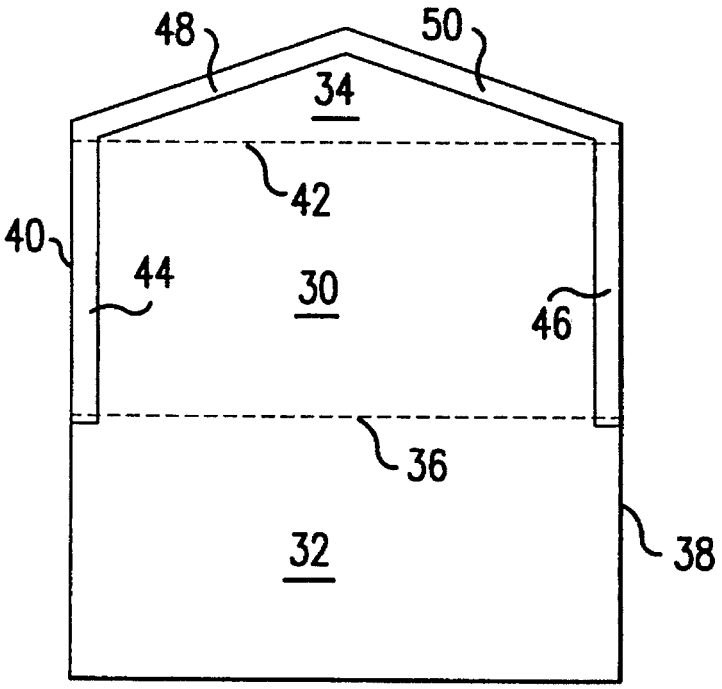
FIG. 3 is a plan view of the inner surface of the envelope blank of FIG. 2.

As illustrated in FIG. 3, glue or adhesive is provided on the inner surface of the envelope blank. The adhesive is formed in adhesive strips 44 and 46 which extend along the longitudinal edges 38 and 40 of front panel 30 and slightly into back panel 32 to ensure complete coverage of the entire length of the front panel longitudinal edges. Adhesive strips 48 and 50 extend along the angled sides of triangular closure flap 34 adjacent its free edges. The adhesive strips 44, 46, 48 and 50 are formed as a continuous or patterned adhesive area on the envelope blank.

Figure 4:
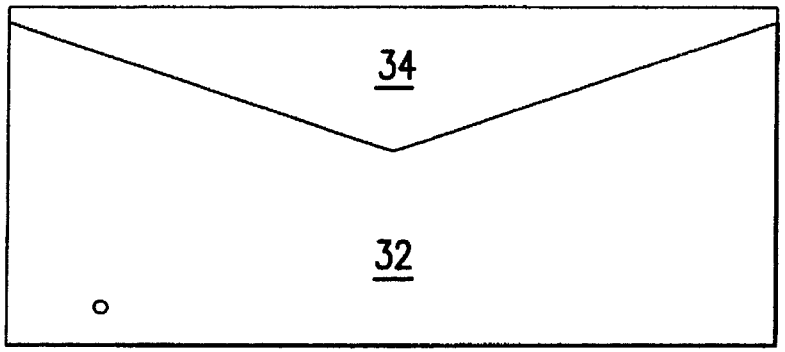
FIG. 4 is a plan view of the completed, stuffed and sealed envelope from the side of the envelope exposing the back panel and closure flap.

In the finished envelope, back panel 32 is folded relative to front panel 30 along fold line 36 such that the inner surfaces of the two panels are directed toward each other. This folding enables glue strips 44 and 46 to close the longitudinal ends of the envelope by securing front panel 30 to back panel 32. Subsequently, closure flap 34 is folded relative to front panel 30 along fold line 42 to overlie the outer surface of back panel 32 as illustrated in FIG. 4. In this position, adhesive strips 48 and 50 close and seal the top of the envelope by securing closure flap 34 to the outer surface of back panel 32.

Figure 5:
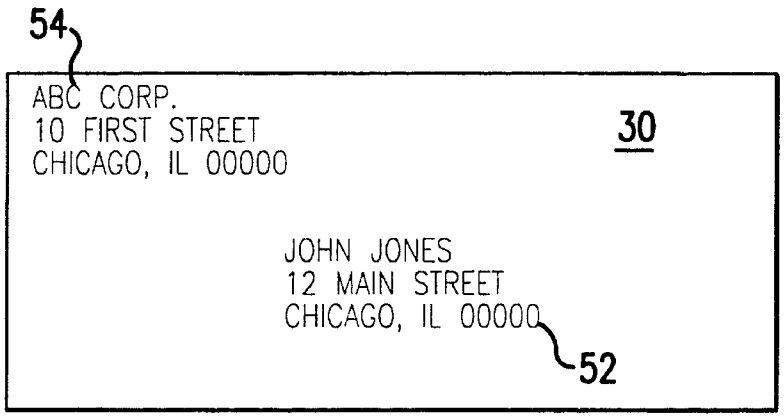
FIG. 5 is a plan view of the front panel of the stuffed envelope of FIG. 4.

As illustrated in FIG. 5, front panel 30 can be imprinted with the appropriate addressee information 52 and return address information 54 in appropriate areas of the outer surface of front panel 30.

From the envelope input means, envelope blanks 14 pass through a variable pattern adhesive applicator 56. The adhesive applicator is located between envelope input means 12 and envelope forming means 16. The adhesive applicator generally comprises a pair of rollers 58 and 60 and a control 62. Roller 58 is a printing roller for printing the desired pattern of adhesive on envelope blanks 14. In the illustrated embodiment, the printed pattern of adhesive constitutes the strips 44, 46, 48 and 50. Roller 60 is a backup and drive roller which is driven in a controlled manner by control 62.

The envelope blanks are then folded in envelope forming means 16 through the various stages graphically shown in FIG. 1. Stages 16*a*, 16*b*, and 16*c* gradually fold back panels 32 relative to front panels 30, while closure flaps 34 remain coplanar with front panels 30. The front panels and closure flaps remain generally horizontal. Back panels 32 are progressively pivoted downwardly and then upwardly such that outer surfaces of the front and back panels are directed generally toward one another.

In the next stage 16*d*, the envelope blanks pass through an inflection area 16*e*. As the envelope blanks pass toward the inflection area, the front panels and closure flaps are directed toward a vertical orientation, and the envelope blank direction of travel is changed by approximately 90 degrees bending the envelope blanks and redirecting them along the path of the inserts. In stage 16*f* the direction of folding of the back panels relative to the front panels is reversed causing the outer surfaces of the front and back panels to be directed generally away from one another and the inner surfaces to be directed toward one another.

As each envelope bypasses through stage 16*d*, inflection area 16*e* and stage 16*f*, the envelope blanks will be progressively stuffed with an insert 24. As a leading or upstream longitudinal end 38 enters stage 16*f*, the front and back panels are brought together to seal or close leading longitudinal end 38 with adhesive strip 46. When leading end 38 enters stage 16f, trailing longitudinal end 40 is still in stage 16*d* with front and back panels separated maintaining trailing longitudinal end of the envelope blank open. As the envelope blank passes through inflection area 16 and into stage 16*f*, the front and back panels are folded to a general parallel relationship with inner surfaces directed toward one another while receiving insert 24. When trailing longitudinal end 40 enters stage 16*f*, the front and back panels are sealed together by adhesive strip 44 to close and seal the trailing longitudinal end of the envelope blank with insert 24 between the front and back panels and between the sealed longitudinal ends 38 and 40.

After both longitudinal ends of the envelope blanks are closed and sealed with the insert between front panel 30 and back panel 32, a closure flap former or plow 64 engages closure flaps 34 and folds the closure flaps along fold lines 42 until the closure flaps are engaged against the outer surfaces of back panels 32. Adhesive strips 48 and 50 seal the closure flaps in closed positions, thereby sealing the envelope tops closed.

An envelope severing mechanism 66 is positioned downstream of closure flap former 64, and separates the individual stuffed envelopes from the continuous web of envelope blanks. The severing mechanism includes an outer ply pull nip 68 operated by a differential registration motor 70, and a drop in cross cutter 72 downstream of nip 68. Nip 68 grips and holds the envelope blanks in proper positions during the actual severing operation by cutter 72. Adjacent envelope blanks are separated between glue strips 44 and 46 thereof. Following cutter 72 the individual stuffed envelopes 74 are collected for further distribution. In a typical example, the formed and stuffed envelope 74 is 9 ⅓ inches wide and 4 ⅛ inches high.

The insert blanks 20 can take a variety of forms. In the illustrated embodiment, the insert blank comprises a continuous web of material which can be divided into 8 ½ ×11 sheets of paper. The insert blanks are conveyed from an insert blank preparation station 76. Station 76 can print the continuous web or supply a pre-printed web from a roll unwinder. Other inserts in the form of single ply sheets able to fit within the envelope with single folds or no folds or in the form of return envelopes can also be supplied in lieu of or in combination with other inserts. Additionally, station 76 can include a printer, such as an ink jet or ion dep printer for printing appropriate information on the insert(s).

In the specific embodiment illustrated in FIG. 1, insert blanks 20 are initially received in insert input means 18 received after printing, as part of a continuous web. Insert forming means 22 includes a plow arrangement 78 for folding insert blank 20 in stages 78*a*, 78*b* and 78*c* into three plies.

Figure 6:
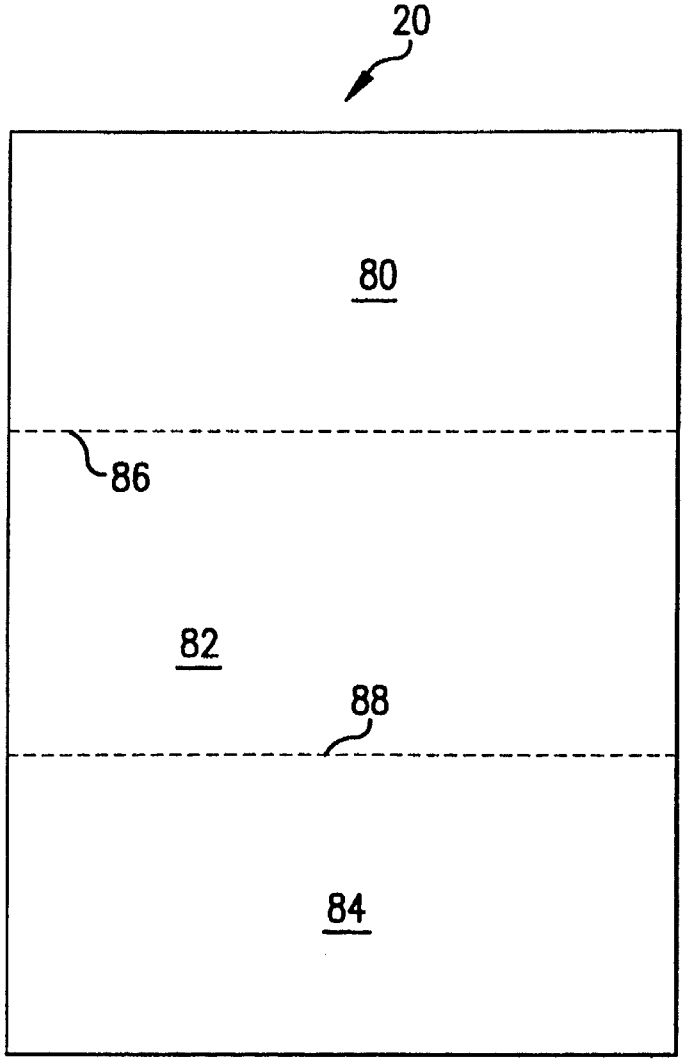
FIG. 6 is a plan view of a insert blank prior to being folded.

Specifically, as illustrated in FIG. 6, insert blank 20 comprises rectangular portions 80, 82 and 84 separated respectively by fold lines 86 and 88. In stages 78*a*, 78*b* and 78*c*, the insert blank 20 is folded along fold lines 86 and 88 such that the portions 80, 82 and 84 overlie one another.

Downstream of plow arrangement 78, insert forming means 22 comprises a nip mechanism 90 and a drop in cross cutter 92 for cutting the continuous web of insert blanks into individual sets of inserts 24.

After severing, inserts 24 enter an insert speed-up take-off section 94 for adjusting the speed of conveyance of the inserts to the travel or conveyance speed of the envelope blanks. Specifically, section 94 accelerates the inserts to separate adjacent inserts and to increase the speed of the inserts to the conveyance speed of the envelopes. Once at the proper speed, inserts 24 are inserted within the partially formed envelope, as described above, by the stuffing mechanism 26 which moves the inserts along their longitudinal axis into the partially formed envelopes at inflection area 16*e*. In inflection area 16*e*, the inserts are grabbed and pulled forward by the envelopes.

Speed up take-off section 94 can comprise sets of pegs 95 mounted on gear driven chains. The pegs engage and push the inserts at their trailing edges. The speed and spacing of the inserts can be adjusted by the gear drive.

As illustrated in FIG. 1, the path of the envelope blanks and the path of the insert blanks and inserts are angularly oriented upstream of inflection area 16*e* within envelope forming means 16. The angular orientation can be perpendicular. This angular orientation provides a particularly efficient arrangement of the device and allows each of the inserts and envelopes to be adapted to different forms.

Figure 7:
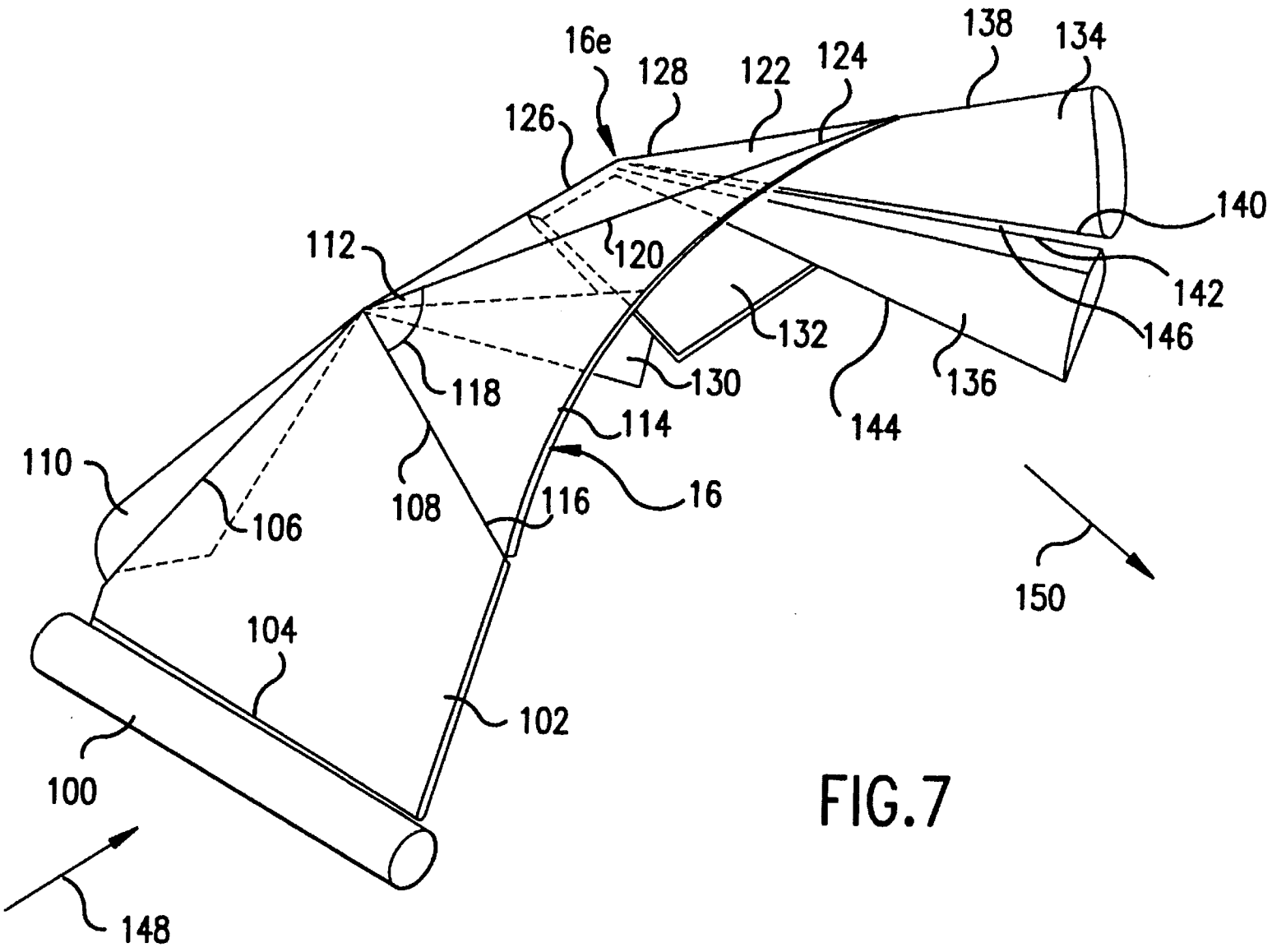
FIG. 7 is a perspective view graphically illustrating the paper contacting surfaces of the envelope forming means of the apparatus of FIG. 1.

FIG. 7 illustrates the parts of the apparatus providing the paper contacting surfaces of envelope forming means 16. Thus, these parts constitute the significant parts of the envelope forming means. The supporting structure for these parts is not illustrated to facilitate illustration of the paper contacting parts.

The inlet or upstream end of envelope forming means 16 comprises a cylindrical idler roller 100. Roller 100 is rotatably mounted in bearings at its longitudinal ends.

A substantially planar former plate 102 is located immediately above or upstream of idler roller 100. The former plate has a lower edge 104 along and adjacent idler roller 100, an angled edge 106 and a top edge 108. An upwardly tapering turn cone 110 is mounted and extends longitudinally along angled edge 106 of the former plate. A former nose cone 112 and a top curve sheet 114 are mounted along former plate top edge 108. The point of former nose cone 112 is adjacent to the intersection of edges 106 and 108 of former plate 102. Top curve sheet 114 has a lower edge 116 abutting former plate at the top edge 108, a curved side edge 118 abutting the corresponding edge of former nose cone 112, and an upper edge 120 remote from former plate 102.

A substantially planar top infeed plate extends downwardly and away from top curve sheet 114. The triangular shape of top infeed plate 122 defines edges 124, 126 and 128. Top infeed plate edge 124 abuts top curve sheet edge 120. Side edge 126 of top infeed plate 122 extends from the point of former nose cone 112 and the intersection of former plate edges 106 and 108, as well as the top point of turn cone 110. In this manner, feed plate 102, turn cone 110, former nose cone 112, and top infeed plate 122 define surfaces which meet at a common point.

Below former plate 102, top curve sheet 114 and top infeed plate 122, an invert cone 130 and a lower infeed plate 132 are mounted. Invert cone 130 is mounted adjacent former nose cone 112 such that the point of invert cone 130 substantially coincides with the point of nose cone 112, as well as with turn cone 110. Lower infeed plate 132 is oriented at an acute angle with and abuts top infeed plate 122. The lower infeed plate has an edge extending along top infeed plate side edge 126.

The output or downstream end of envelope forming means 16 comprises a top nip cone 134 and a bottom nip cone 136. Both nip cones taper in the direction of the mating edges of infeed plates 122 and 132. Top nip cone 134 has an upper edge 138 and a lower edge 140. Similarly, bottom nip cone 136 has an upper edge 142 and a lower edge 144. Top nip cone upper edge 138 is substantially in the plane of the upper surface of top infeed plate 122. Lower edge 144 of bottom nip cone 136 substantially lies in the plane of the lower surface of lower infeed plate 132. Top nip cone lower edge 140 and bottom nip cone upper edge 142 are spaced by a gap 146.

In operation, envelope blanks enter the envelope forming means from below and generally in the direction indicated by arrow 148 from adhesive applicator 56, and passes over idler roller 100. The envelope blanks are positioned to align fold line 36 between envelope blank panels 30 and 32 along angled edge 106 of former plate 102. In this manner, former plate 102, top curve sheet 114, top infeed plate 122 and top nip cone 134 engage front panels 30 and closure flaps 34 of the envelope blanks. Turn cone 110, invert cone 130, lower infeed plate 132 and bottom nip cone 136 engage back panels 32 of the envelope blanks. The envelope blanks exit the envelope forming means in the direction of arrow 150 with the front and back panels sealed together and containing the inserts therebetween.

The envelope blanks enter envelope forming means 16 at idler roller 100 with panels 30 and 32 and flap 34 coplanar. As each envelope blank moves along former plate 102 and turn cone 110 with fold line 36 along angled edge 106, back panel 32 is folded relative to front panel 30, while closure flap 34 remains coplanar with the front panel. The adhesive strips, 44, 46, 48 and 50 face upwardly, i.e., on the surface of the envelope blank facing away from the former plate. The back panel progressively pivots downwardly by turn cone 110 and then pivots upwardly by invert cone 130, as the blank passes through the intersection of the points of cones 110, 112 and 130.

While the back panel is being folded, the front panel and the closure flap pass over top curve sheet 114 and top infeed plate 122, with fold line 36 extending along top infeed plate side edge 126.

Inflection area **16*e* is provided at the intersection of the small ends or points of nip cones 134 and 136 and the adjacent corners of infeed plates 122 and 132. As each envelope blank passes from the infeed plates to the nip cones, the envelope blanks are reverse folded along fold line 36, while the envelope blank direction of travel is changed by 90 degrees. As the front panel 30 and closure flap 34 pass over nip cone 134 and back panel 34 passes over bottom nip cone 136 from cone edges 138 and 144, respectively, toward gap 146, the inserts are fed between the front and back panels from speed up take-off section 94. As the envelope panels and the inserts pass through gap 146, the inserts are grabbed and pulled forward by the envelopes. Thus, the passage of the envelope blanks and the inserts through gap 146** closes and seals the longitudinal ends of the envelope blanks and causes the envelope blanks to grab and pull the inserts along with the envelope blanks to the downstream processing stages of the system.

While a particular embodiment has been chosen to illustrate the invention, it will be understood by those skilled in the art that various changes and modifications can be made therein without departing from the scope of the invention as defined in the appended claims.

What is claimed is:

1. An apparatus for forming and sealing envelopes, each stuffed with at least one insert, comprising:

envelope input means for receiving and feeding envelope blanks with opposite first and second longitudinal ends;

envelope forming means, downstream of said envelope input means, for partially forming the envelope blanks with the first longitudinal ends sealed and the second longitudinal ends open;

insert input means, upstream of said envelope forming means, for receiving and feeding insert blanks along longitudinal axis thereof;

insert forming means, between said insert input means and said envelope forming means, for forming the insert blanks into inserts; and stuffing means, adjacent said envelope forming means, for moving the inserts along longitudinal axes thereof and into the open second longitudinal ends of the envelope blanks, while the envelope blanks are partially formed in said envelope forming means, parallel to longitudinal axes of the envelope blanks.

2. An apparatus according to claim 1 wherein said envelope input means and said insert input means define angularly oriented paths for the envelope blanks and the insert blanks, respectively, during movement toward said envelope forming means.

3. An apparatus according to claim 1 wherein the envelope blanks have closure flaps; and flap closing means is located downstream of said envelope forming means for closing and sealing the closure flaps.

4. An apparatus according to claim 1 wherein adhesive means is located between said envelope input means and said envelope forming means for applying adhesive to the envelope blanks.

5. An apparatus according to claim 4 wherein each envelope blank comprises front and back panels connected along a fold line, and a closure flap connected to the front panel;

said adhesive means applies adhesive to the envelope blanks adjacent free edges of the closure flaps and the front panels.

6. An apparatus according to claim 1 wherein said envelope input means feeds envelope blanks coupled end to end as a continuous web.

7. An apparatus according to claim 1 wherein the envelope blanks include front and back panels connected along fold lines;

said envelope forming means folds the envelope blanks causing outer surfaces of the front and back panels to be directed generally toward one another and then reverses direction of folding at an inflection area to then fold the envelope blanks causing the outer surfaces of the front and back panels to be directed generally away from one another; and said stuffing means moves the inserts between the front and back panels of the envelope blanks in said inflection area.

8. An apparatus according to claim 7 wherein envelope closing means are provided downstream of said envelope forming means for closing and sealing the envelope blanks with the inserts therein to form stuffed envelopes.

9. An apparatus according to claim 8 wherein said envelope input means feeds envelope blanks coupled end to end as a continuous web.

10. An apparatus according to claim 9 wherein severing means are provided downstream of said envelope closing means for separating individual stuffed envelopes.

11. An apparatus according to claim 8 wherein the envelope blanks have generally triangular closure flaps; and said envelope closing means comprises flap closing means for folding and sealing the closure flaps.

12. An apparatus according to claim 7 wherein said inflection area comprises a top nip cone and a bottom nip cone, said nip cones tapering toward said inflection area and being separated along lengths thereof by a gap.

13. An apparatus according to claim 12 wherein top and lower infeed means are located adjacent said top and bottom nip cones, respectively, for conveying the front panels over a top edge of said top nip cone and around said top nip cone and for conveying the back panels under a bottom edge of said bottom nip cone and around said bottom nip cone, such that the front and back panels subsequently pass together with the inserts through said gap.

14. An apparatus according to claim 13 wherein said envelope forming means comprises a former plate having an angled edge means for engaging fold lines between the front and back panels of said envelope blanks.

15. An apparatus according to claim 13 wherein said envelope forming means comprises turn cone means extending along and adjacent said angled edge means and tapering in an upstream direction, for folding the back panels relative to the front panels.

16. An apparatus according to claim 15 wherein said envelope forming means comprises invert cone means for conveying the back panels between said turn cone and said lower infeed means.

17. An apparatus according to claim 1 wherein said insert forming means comprises severing means for separating individual inserts from a continuous web.

18. An apparatus according to claim 17 wherein said insert forming means comprises folding means for folding the insert blanks.

19. An apparatus according to claim 1 wherein said insert forming means pre-assemblies sets of inserts for simultaneous stuffing of one of the sets in each of said envelope blanks by said stuffing means.

20. A method for forming and sealing envelopes, each stuffed with at least one insert, comprising:

receiving and feeding envelope blanks with opposite first and second longitudinal ends;

partially forming the envelope blanks with the first longitudinal ends sealed and the second longitudinal ends open;

receiving and feeding insert blanks along longitudinal axis thereof;

forming the insert blanks into inserts; and moving the inserts along longitudinal axes thereof and into the open second longitudinal ends of the partially formed envelope blanks parallel to longitudinal axes of the envelope blanks.

21. A method according to claim 20 wherein the envelope blanks and the insert blanks are conveyed along respective angularly oriented paths during movement toward a station where the inserts are inserted into the envelope blanks.

22. A method according to claim 20 wherein envelope blanks with closure flaps are fed; and the closure flaps are closed and sealed after the inserts are inserted into the envelope blanks.

23. A method according to claim 20 wherein adhesive is supplied to the envelope blanks before the inserts are inserted into the envelope blanks.

24. A method according to claim 23 wherein each envelope blank being fed comprises front and back panels connected along a fold line, and a closure flap connected to the front panel; and adhesive is applied to the envelope blanks adjacent free edges of the closure flaps and the front panels.

25. A method according to claim 20 wherein the envelope blanks are fed as a continuous web with the envelope blanks coupled end to end.

26. A method according to claim 20 wherein the envelope blanks being fed include front and back panels connected along fold lines;

the envelope blanks are folded causing outer surfaces of the front and back panels to be directed generally toward one another and are then folded in a reverse direction of folding at an inflection area causing the outer surfaces of the front and back panels to be directed generally away from one another; and the inserts are conveyed between the front and back panels of the envelope blanks in the inflection area.

27. A method according to claim 26 wherein the envelope blanks with the inserts therein are closed and sealed after the inserts are inserted in the envelope blanks to form stuffed envelopes.

28. A method according to claim 27 wherein the envelope blanks are fed as a continuous web with the envelope blanks coupled end to end.

29. A method according to claim 28 wherein individual stuffed envelopes are separated after the closing and sealing.

30. A method according to claim 27 wherein the envelope blanks being fed have generally triangular closure flaps; and the closure flaps are folded and sealed after the inserts are inserted into the envelope blanks.

31. A method according to claim 20 wherein individual inserts are separated from a continuous web prior to insertion into the envelope blanks.

32. A method according to claim 31 wherein the insert blanks are folded prior to insertion into the envelope blanks.

33. A method according to claim 20 wherein sets of inserts are pre-assembled for simultaneous stuffing of one set in each of said envelope blanks.

* * * * *